US007865108B2

(12) United States Patent
Shibuya et al.

(10) Patent No.: US 7,865,108 B2
(45) Date of Patent: Jan. 4, 2011

(54) CLEANING DEVICE AND IMAGE FORMING DEVICE FOR CHARGING RESIDUALS OF TONER EVENLY

(75) Inventors: Satoru Shibuya, Chiryu (JP); Hisashi Murata, Toyohashi (JP); Kazuyoshi Hara, Itami (JP); Hidetoshi Noguchi, Tahara (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 29 days.

(21) Appl. No.: 12/335,906

(22) Filed: Dec. 16, 2008

(65) Prior Publication Data

US 2009/0214276 A1 Aug. 27, 2009

(30) Foreign Application Priority Data

Feb. 26, 2008 (JP) ..... 2008-044340

(51) Int. Cl.
*G03G 15/16* (2006.01)

(52) U.S. Cl. ..... 399/101

(58) Field of Classification Search ..... 399/101, 399/302, 308

See application file for complete search history.

(56) References Cited

U.S. PATENT DOCUMENTS

| | | | | |
|---|---|---|---|---|
| 6,594,457 | B2 * | 7/2003 | Tsutsumi et al. | 399/101 |
| 2004/0213598 | A1 * | 10/2004 | Mori et al. | 399/101 |
| 2007/0059027 | A1 * | 3/2007 | Ishikawa et al. | 399/101 |

FOREIGN PATENT DOCUMENTS

| | | |
|---|---|---|
| JP | 7-008861 | 2/1995 |
| JP | 10-239951 A | 9/1998 |
| JP | 2004-212823 A | 7/2004 |
| JP | 2004-310060 A | 11/2004 |

* cited by examiner

*Primary Examiner*—Hoang Ngo
(74) *Attorney, Agent, or Firm*—Buchanan Ingersoll & Rooney PC

(57) ABSTRACT

A cleaning device for cleaning residual toner that, in an image forming device of an intermediate transfer type, remains on an outer circumferential surface of an intermediate transfer member after a transfer. The cleaning device includes: a charging brush operable to contact with and charge the residual toner; and a cleaner that is disposed downstream of the charging brush in a toner transport direction of the intermediate transfer member, and is operable to electrostatically adsorb the charged residual toner, wherein electrically conductive bristles have been planted randomly in the charging brush to be distributed evenly in density.

10 Claims, 14 Drawing Sheets

CLEANING DEVICE AND IMAGE FORMING DEVICE FOR CHARGING RESIDUALS OF TONER EVENLY

This application is based on application No. 2008-44340 filed in Japan, the contents of which are hereby incorporated by reference.

BACKGROUND OF THE INVENTION (1) Field of the Invention

The present invention relates to a cleaning device and an image forming device, and especially to a technology for charging residuals of toner or the like evenly when cleaning an intermediate transfer member.

(2) Description of the Related Art

In the intermediate transfer type image forming devices, toner images are first transferred onto an intermediate transfer member by multiple transfers, and then transferred onto a recording sheet. After the transfer, toner and the like that remain on the surface of the intermediate transfer member are removed by a cleaning device.

As cleaning devices for use for this purpose, various types have been proposed including the following one (for example, see Japanese Patent Application Publication No. 2004-310060). First, an electrically conductive roll brush, while a constant current is applied thereto, is contacted with residual toner on an intermediate transfer belt to cause the residual toner to have a same charging polarity. After this, the residual toner is electrostatically adsorbed to an electrically conductive cleaning brush while a constant current is applied thereto.

The residual toner electrostatically adsorbed to the cleaning brush is then further electrostatically adsorbed to a collection roller, and scraped off therefrom by a scraper.

The toner images having been transferred onto the intermediate transfer belt have the same polarity. As a result, to prevent toner images from repelling each other and prevent a transfer deficiency from being generated due to this, a larger transfer bias is applied as the number of image transfers increases. This makes it unable for the cleaning brush to collect the whole residual toner since the toner remaining on the surface of the intermediate transfer member after the second transfer is greatly varied in the charging state.

In respect of the problem, it has been expected that the amount of uncollected residual toner would be minimized by using a charging brush to charge the residual toner evenly to have the same polarity.

In the actuality, however, it is still observed that a certain amount of residual toner remains uncollected by the cleaning brush. It is considered that this is because the roll brush does not charge the residual toner to a sufficient level of evenness.

A typical roll brush adopted for the above-described purpose is manufactured by wrapping around a core bar a piece of electrically conductive cloth on which a large number of electrically conductive bristles have been planted. However, as shown in FIG. 1, there are gaps 1301 between rolls of the piece of cloth wrapped around the core bar. The gaps 1301 differ from the rolls of the piece of cloth in density of planted bristles.

The gaps 1301 differ from the rolls of the piece of cloth in the efficiency of charging the residual toner. Also, the gaps have a lower charging potential than the rolls of the piece of cloth. It is thus difficult for the cleaning brush to charge the residual toner evenly. The cleaning brush with this structure cannot collect the whole residual toner.

A bar brush can be used instead of a roll brush to charge the residual toner evenly. The bar brush is manufactured by bonding a cloth with bristles with a metal platform by an electrically conductive adhesive. With use of such a bar brush, it is possible to charge the residual toner to a certain level of evenness.

In the case of the bar brush, as shown in FIG. 2, there are gaps between rows of bundles of bristles arranged in the length direction, and there are also gaps between rows of bundles of bristles arranged in the width direction. Gaps 1401 differ from the rows of bundles of bristles in density of planted bristles.

The gaps 1301 differ from the rolls of the piece of cloth in the efficiency of charging the residual toner. Also, the gaps have a lower charging potential than the rolls of the piece of cloth. It is thus difficult for the cleaning brush to charge the residual toner evenly. The cleaning brush with this structure cannot collect the whole residual toner. Also, different from the roll brush, tips of bristles of the bar brush hardly move during the use. As a result, unevenness in the density of planted bristles generates, in a direct relation, unevenness in polarity of the charged residual toner.

When a certain amount of residual toner remains uncollected by the cleaning brush due to the unevenness in polarity of the charged residual toner, an image quality deterioration is generated eventually.

One may consider that the problem might be solved by increasing the number of planted bristles to increase the density of bristles in the gaps of the roll or bar brush. However, this will remarkably increase the density of planted bristles in the portions other than the gaps. The charging brushes with such high density are apt to be clogged with toner. This would create another new problem that the charging efficiency is deteriorated due to the clog, and the life of the charging brush is reduced.

SUMMARY OF THE INVENTION

The object of the present invention is therefore to provide a cleaning device and an image forming device which solve the problem of charging deficiency that is caused due to unevenly planted bristles of the charging brush.

The above object is fulfilled by a cleaning device for cleaning residual toner that, in an image forming device of an intermediate transfer type, remains on an outer circumferential surface of an intermediate transfer member after a transfer, the cleaning device comprising: a charging brush operable to contact with and charge the residual toner; and a cleaner that is disposed downstream of the charging brush in a toner transport direction of the intermediate transfer member, and is operable to electrostatically adsorb the charged residual toner, wherein electrically conductive bristles have been planted randomly in the charging brush to be distributed evenly in density.

With the above-described structure, there is no gap between rolls of cloth with bristles or between rows of bundles of bristles, and thus it is possible to charge the residual toner evenly. This eliminates the cleaning deficiency caused by the charging deficiency, and achieves an excellent image quality.

In the above-described cleaning device, the bristles may have been planted in the charging brush by an electrostatic planting method.

In the above-described cleaning device, the charging brush may be either a roll brush or a bar brush.

The above object is also fulfilled by a cleaning device for cleaning residual toner that, in an image forming device of an intermediate transfer type, remains on an outer circumferential surface of an intermediate transfer member after a transfer, the cleaning device comprising: a charging brush operable to contact with and charge the residual toner; and a cleaner that is disposed downstream of the charging brush in a toner transport direction of the intermediate transfer member, and is operable to electrostatically adsorb the charged residual toner, wherein 279 or more electrically conductive bristles have been planted in any one square millimeter area in a bristle planting region of the charging brush.

With the above-described structure, the density of the planted bristles is sufficient in any area in the bristle planting region of the charging brush, and thus it is possible to eliminate the charging deficiency that is caused by the insufficient density of the planted bristles.

In the above-described cleaning device, each of the electrically conductive bristles may be 2 denier in thickness.

With the above-described structure, it is possible to eliminate the charging deficiency that is caused by a clog of the charging brush with toner.

In the above-described cleaning device, the bristles of the charging brush may be a combination of one or more types of bristles each of which is made of a material selected from the group consisting of an electrically conductive nylon-based resin, an electrically conductive ester-based resin, an electrically conductive rayon-based resin, an electrically conductive acrylic-based resin, and an electrically conductive polypropylene-based resin.

The above object is also fulfilled by an image forming device that includes the above-described cleaning device. The structure thereof eliminates the cleaning deficiency caused by the charging deficiency, and achieves an excellent image quality.

BRIEF DESCRIPTION OF THE DRAWINGS

These and the other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENTS

The following describes embodiments of the cleaning device and image forming device of the present invention with reference to the attached drawings.

[1] Embodiment 1

First, a tandem color image forming device (in Embodiments 1 and 2, merely referred to as an image forming device) in Embodiment 1 will be described.

(1) Structure of Image Forming Device

An image forming device of the present embodiment will be described.

Figure 1:
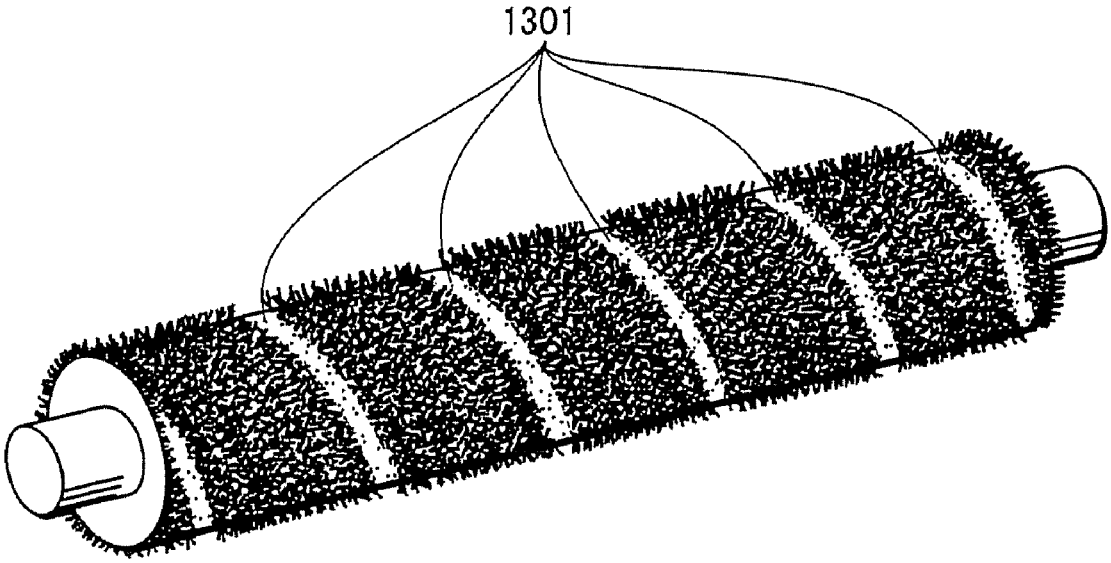
FIG. 1 shows how bristles are planted in a roll brush in a conventional technology.
Figure 2:
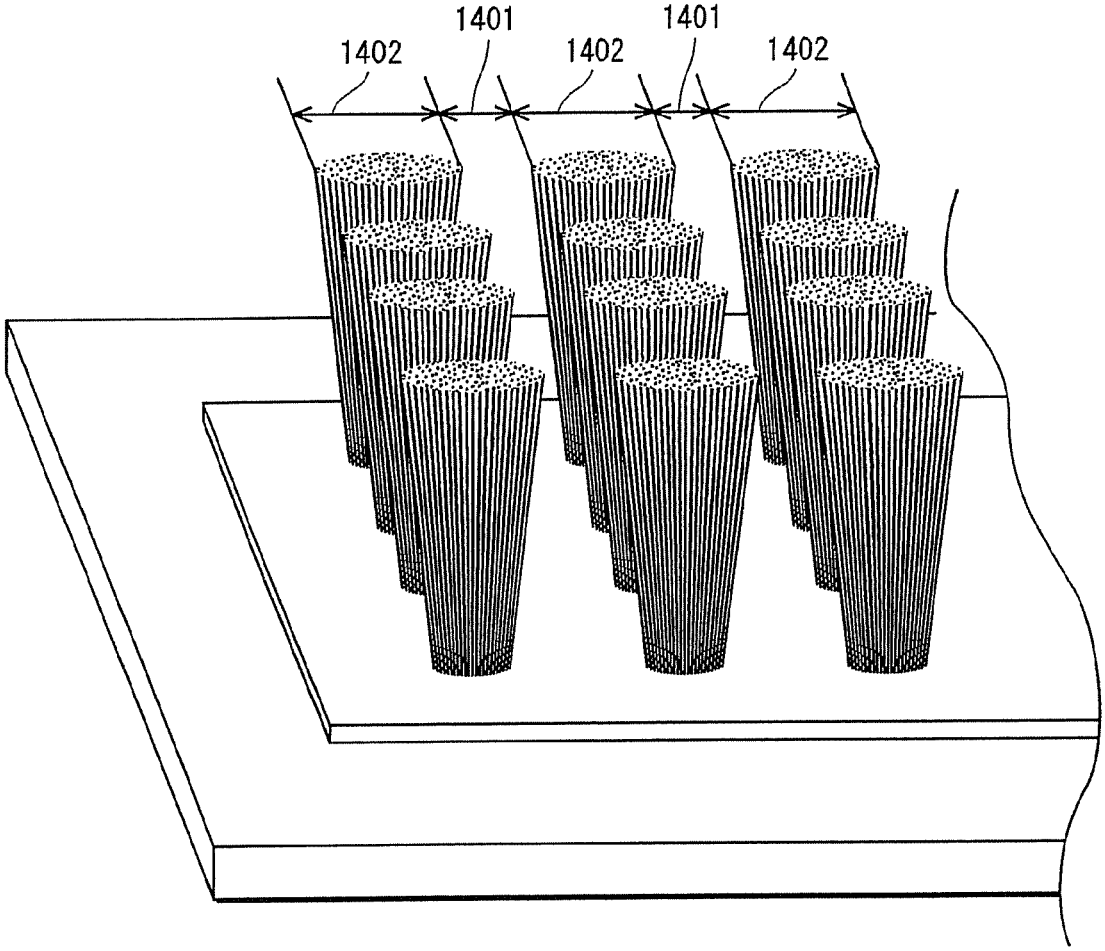
FIG. 2 shows how bristles are planted in a bar brush in a conventional technology.
Figure 3:
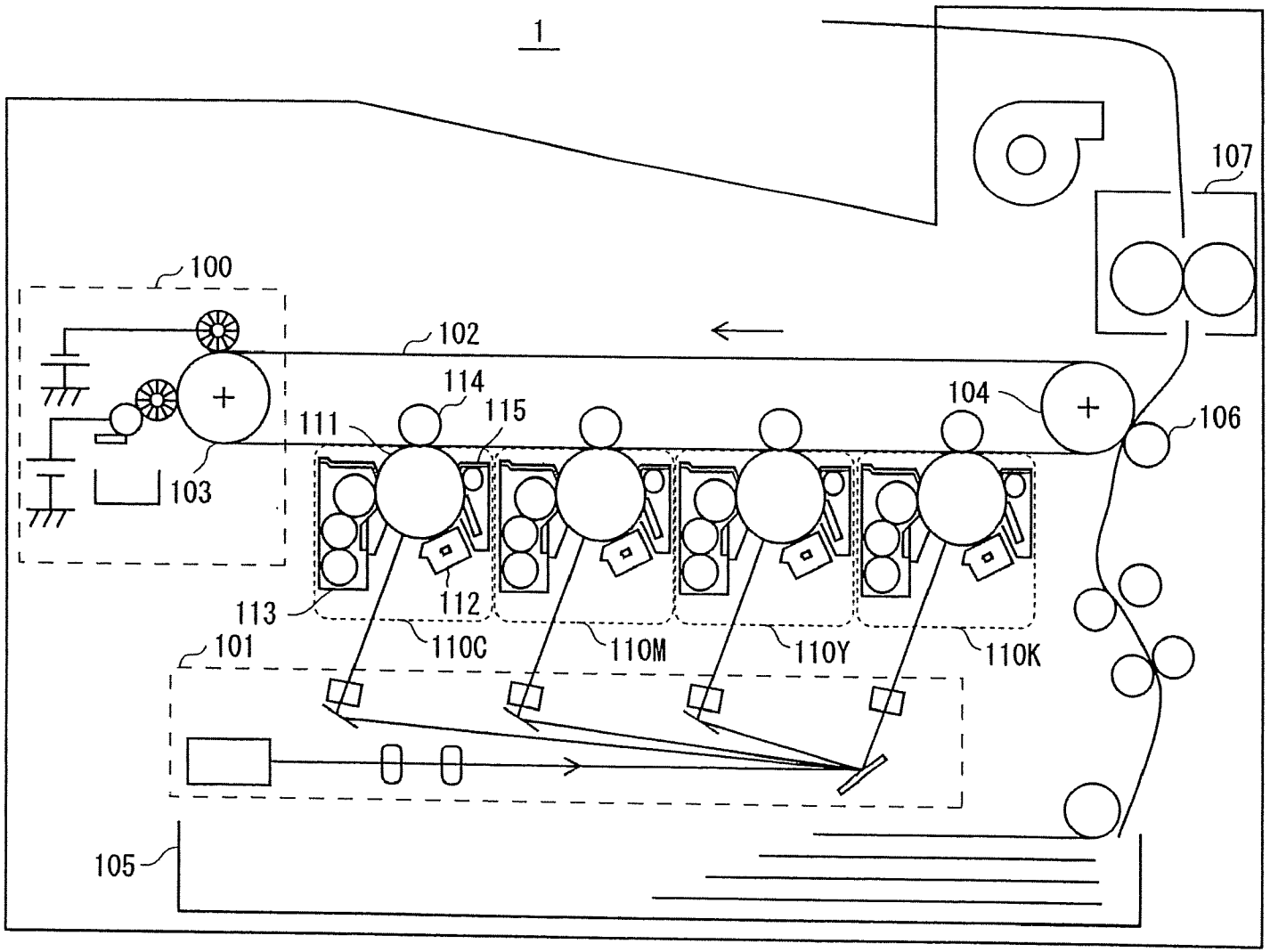
FIG. 3 shows a main structure of the image forming device in Embodiment 1.

FIG. 3 shows a main structure of the image forming device in the present embodiment. As shown in FIG. 3, an image forming device 1 includes a cleaning device 100, a laser unit 101, an intermediate transfer belt 102, a suspension roller 103, a suspension roller 104, a paper feed cassette 105, a second transfer roller 106, a fixing device 107, and image forming units 110C, 110M, 110Y and 110K corresponding respectively to colors of cyan (C), magenta (M), yellow (Y) and black (K).

The image forming unit 110C includes a photosensitive drum 111, a charging device 112, a developing device 113, a transfer roller 114, and a photosensitive drum cleaning device 115. These elements 112 through 115 are arranged in the stated order along the rotation direction of the photosensitive drum 111. The image forming units 110M, 110Y and 110K have the same structure as the image forming unit 110C.

When the image forming device 1 performs the image forming process, first, the charging devices 112 of the image forming units 110C through 110K cause the circumferential surface of the photosensitive drum 111 to be charged uniformly. Then, the circumferential surface of the photosensitive drum 111 is exposed to the laser light emitted from the laser unit 101, so that static latent images are formed on the circumferential surface.

The static latent images formed on the circumferential surface of the photosensitive drum ill are developed by the developing device 113, so that toner images are formed. The toner images are transferred onto the intermediate transfer belt 102 by the first transfer roller 114.

The intermediate transfer belt 102 is suspended between the suspension roller 103 and the suspension roller 104 making a pair, and onto which toner images of the four colors are transferred by the image forming units 110C through 110K. In this transfer, the transfer timing is adjusted so that the toner images of the four colors are layered on the intermediate transfer belt 102 at the same position. The intermediate transfer belt 102 transfers the toner images to a second transfer position.

On the other hand, the paper feed cassette 105 feeds recording sheets that are also transferred to the second transfer position. At the second transfer position, the toner images are transferred from the intermediate transfer belt 102 onto the recording sheets by the second transfer roller 106. The toner images on the recording sheets are melted and pressed onto the recording sheets by the fixing device 107.

After the transfer, the cleaning device 100 collects the residual toner from the surface of the intermediate transfer belt 102 as will be described later.

(2) Structure of Cleaning Device 100

Next, the structure of the cleaning device 100 will be described.

Figure 4:
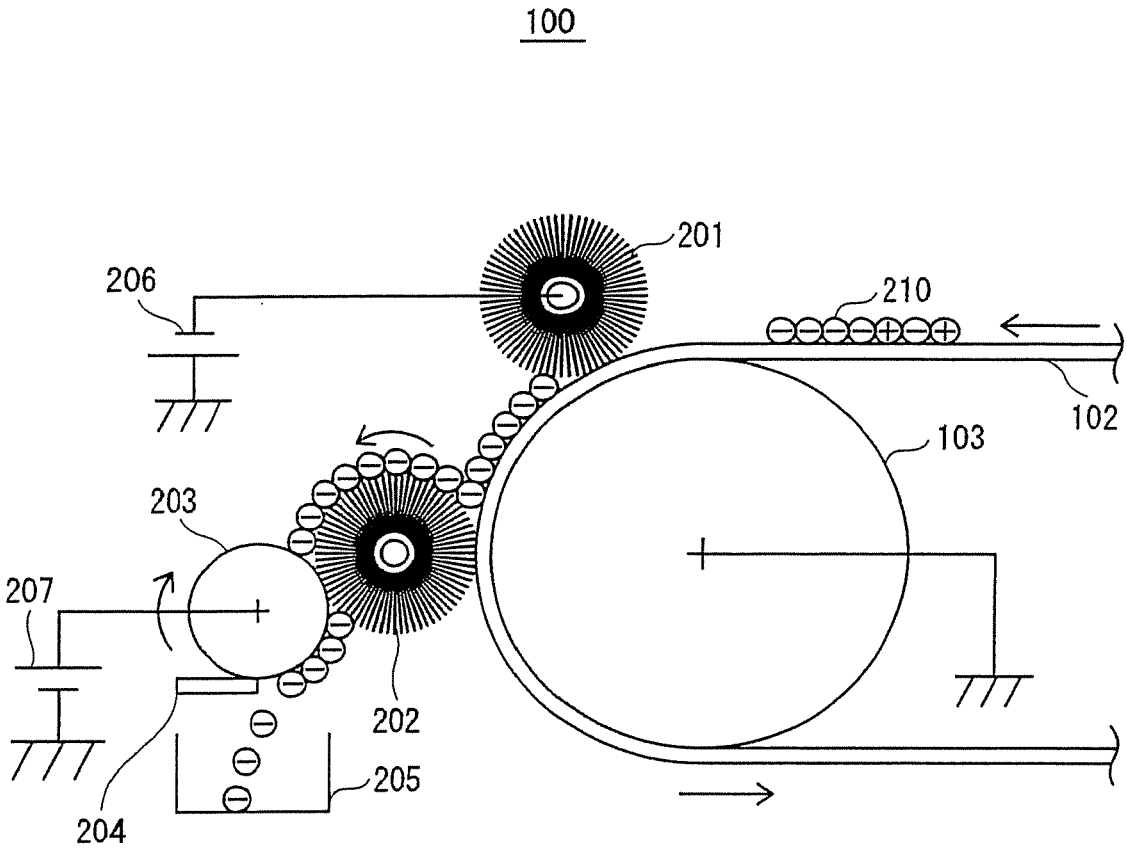
FIG. 4 shows a main structure of the cleaning device 100.

As shown in FIG. 4, the cleaning device 100 includes a charging brush 201, a cleaning brush 202, a collection roller 203, a scraper 204, a disposal toner box 205, and constant voltage sources 206 and 207.

The charging brush 201 is a roll brush having electrically conductive bristles planted therein, and is constructed to contact with the intermediate transfer belt 102. The charging brush 201 is driven to rotate such that there is a linear velocity difference from the intermediate transfer belt 102. This arrangement increases the probability that the bristles and the intermediate transfer belt 102 contact with each other, and makes the potential of the residual toner even.

The constant voltage source 206 applies to the charging brush 201 a bias that has the same polarity as the toner (in the example of FIG. 4, negative electric charge). The suspension roller 103 is grounded. The current flows from the charging brush 201 to the suspension roller 103 so as to cause residual toner 210 to have the same polarity.

The cleaning brush 202 is also a roll brush having electrically conductive bristles planted therein, and is constructed to contact with the intermediate transfer belt 102. The charging brush 202 is driven to rotate to counter the intermediate transfer belt 102.

The constant voltage source 207 applies to the cleaning brush 202, via the collection roller 203, a bias that has a polarity (in the example of FIG. 4, positive electric charge) that is opposite to the polarity of the toner. With this structure, the current flows from the suspension roller 103 to the cleaning brush 202 so that the residual toner 210 is electrostatically adsorbed to the cleaning brush 202.

The collection roller 203 is constructed to be in contact with the cleaning brush 202, and is passively driven by the cleaning brush 202 to rotate. As described above, as a bias is applied to the constant voltage source 207, the residual toner 210 is collected from the cleaning brush 202 and is then electrostatically adsorbed to the collection roller 203.

The scraper 204, constructed to be in contact with the collection roller 203, scrapes off the residual toner 210, which has been electrostatically adsorbed to the collection roller 203, from the collection roller 203, and discards the scraped-off residual toner into the disposal toner box 205. When the cleaning brush 202 has failed to remove all external additive that had been added to the toner, a filming removing member (not illustrated) mechanically scrapes off and collects the external additive.

Here is described a toner filming. The toner filming means a state where toner components have been attached to a surface of the photosensitive drum or the like to form a thin film thereof covering a wide area. The toner filming is generated, for example, when a member such as a cleaning blade contacts with the surface of the photosensitive drum, and toner caught therebetween is frictionally heated, melted and attached to the surface of photosensitive drum. With use of the filming removing member, image quality deterioration due to the toner filming can be eliminated.

(3) Charging Brush 201

Next, the charging brush 201 will be described.

(a) Manufacturing Method of Charging Brush 201

In the process of manufacturing the charging brush 201, bristles are planted by an electrostatic planting method. FIGS. 5A through 5D show an example of the manufacturing process of the charging brush 201 by the electrostatic planting method. The process proceeds in the order from FIG. 5A to FIG. 5D.

Figures 5A, 5B, 5C, 5D:
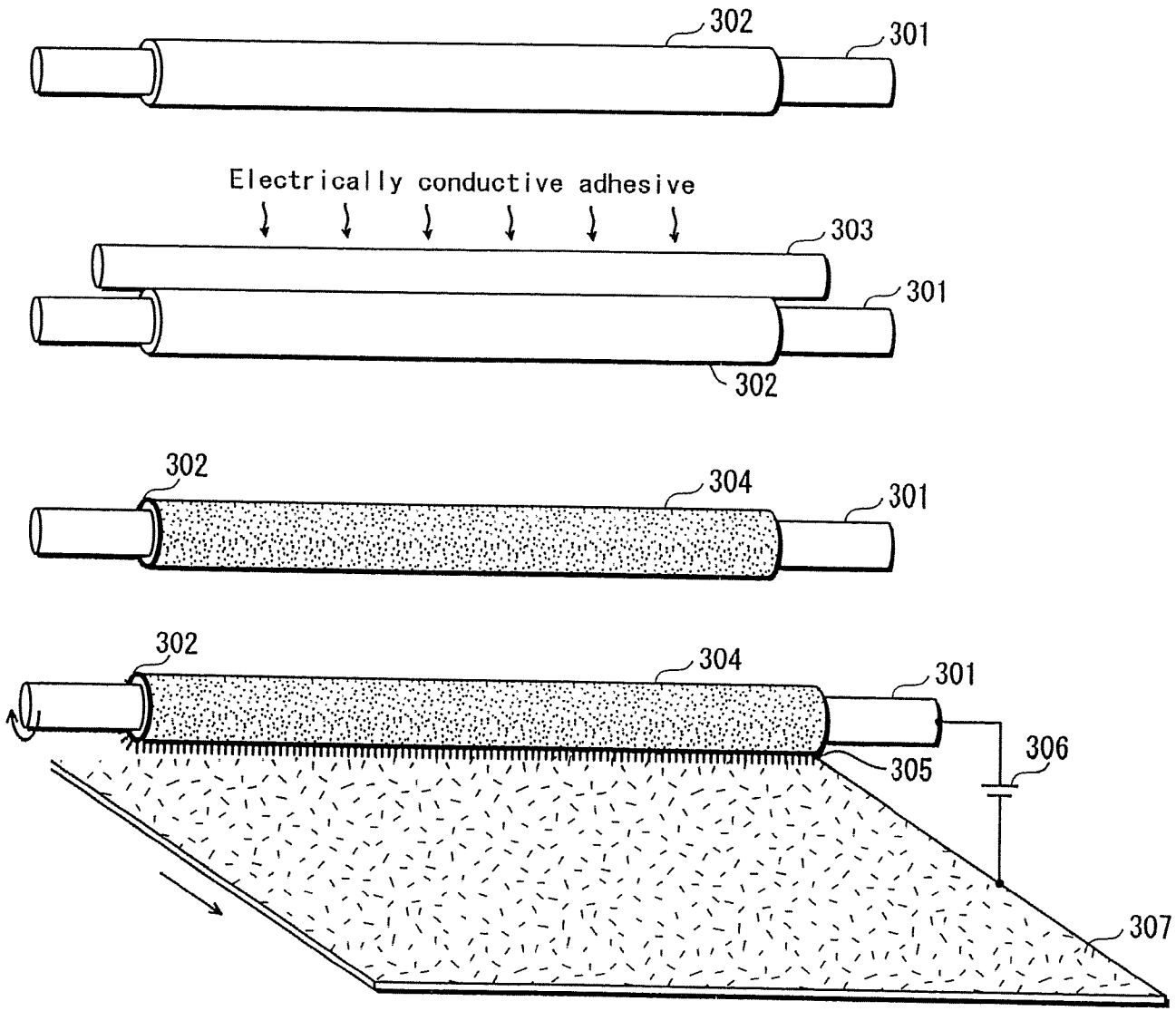
FIGS. 5A through 5D show an example of the manufacturing process of the charging brush 201 by the electrostatic planting method.

As shown in FIGS. 5A through 5D, first, a core metal shaft 301 made of a metal is covered with an electrically conductive member 302 (FIG. 5A). Next, the conductive member 302 is pressed to an application roller 303 that is rotating, and in this state, a liquid conductive adhesive is supplied to the application roller 303 (FIG. 5B). This enables the conductive adhesive to be evenly applied to the circumferential surface of the conductive member 302, so that an electrically conductive adhesive layer 304 is formed (FIG. 5C).

Next, the core metal shaft 301 is disposed above a metal plate 307 on which a large amount of bristles are laid, with a predetermined distance from the surface of the metal plate 307 and to be parallel with the surface. In this state, the core metal shaft 301 is driven to rotate while a constant voltage source 306 keeps applying a constant voltage between the core metal shaft 301 and the metal plate 307, and the metal plate 307 is slid in a direction perpendicular to the core metal shaft 301.

In the present embodiment, nylon 6 of 2 denier is used for the bristles. That is to say, used in the present embodiment is a nylon 6 string that weighs 2 grams when it is 9,000 meters long. Compared with this, strings of 6 denier are too thick to be used as the bristles, and they are apt to be clogged with toner or the like, which will lead to charging deficiencies.

With this structure, the bristles on the metal plate 307 are electrostatically adsorbed to the conductive adhesive layer 304 as the core metal shaft 301 is slid with rotation, so that the bristles are planted into the whole circumferential surface of the conductive adhesive layer 304 to form a planted bristle layer 305 (FIG. 5D) thereon. Then, after the adhesive layer is hardened, a cutter is applied to the planted bristle layer 305 while rotating the core metal shaft 301 at a high speed, so that the planted bristle layer 305 is cut to an even height.

(b) State of Bristles Planted in Charging Brush 201

Next, the state of the bristles planted in the charging brush 201 will be described.

Figure 6A:
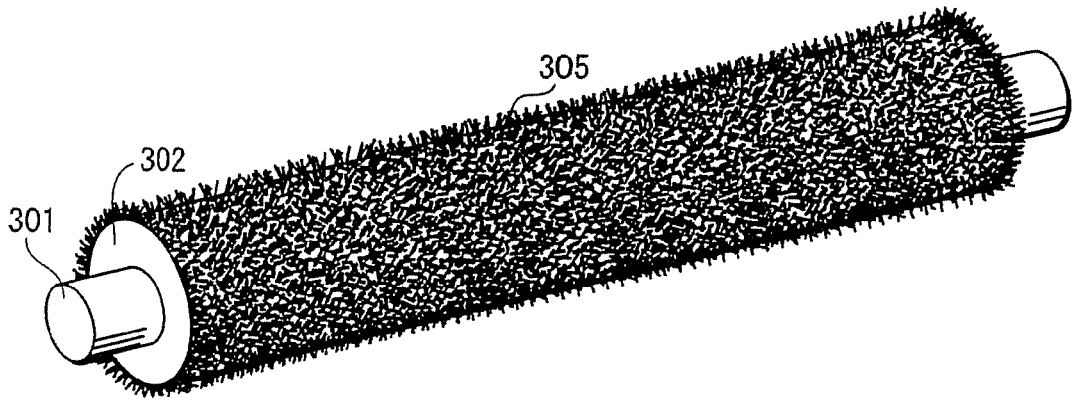
FIGS. 6A and 6B show outer appearances of the charging brush 201, FIG. 4A being a perspective view, FIG. 4B being a side view.
Figure 6B:
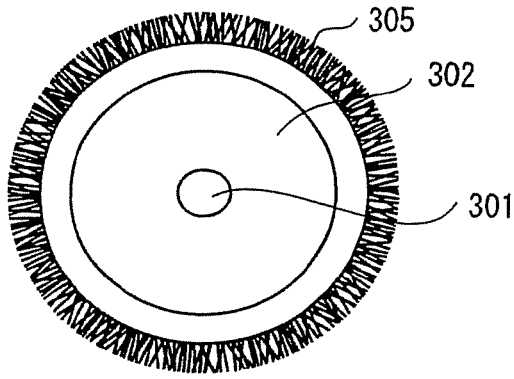

FIGS. 6A and 6B show outer appearances of the charging brush 201. FIG. 6A is a perspective view; and FIG. 6B is a side view. As shown in FIGS. 6A and 6B, the bristles have been planted randomly to be distributed evenly in density.

It should be noted here that the state where the bristles have been planted evenly means that the density of the bristles planted in the surface of the charging brush is 279 filaments per square millimeter (279 F/mm$^2$) or higher, in any area on the surface. Also, the state where the bristles have been planted randomly means that the charging brush has been manufactured by a manufacturing method other than a method in which the bristles are regularly arranged.

According to the results of a performance assessment conducted by the inventors, the problem of uneven charging of the residual toner was not observed when a brush whose density of planted bristles was 210,000 filaments per square inch (210 kF/inch$^2$=279 F/mm$^2$) or 240 kF/inch$^2$ was used, although the problem was observed when used was a charging brush whose density of planted bristles was 180 kF/inch$^2$ even if it had also been manufactured by the electrostatic planting method so that the bristles were planted randomly.

On the other hand, even if used was a charging brush whose density of planted bristles was 210 kF/inch$^2$ (=279 F/mm$^2$), the problem of uneven charging of the residual toner was observed when the planted bristles were uneven in distribution in a square inch, as in conventional charging brushes. Adversely, the problem was not observed when used was a brush whose density of planted bristles was 279 F/mm$^2$ or higher, even if the bristles were a little bit uneven in distribution.

[2] Embodiment 2

Next, an image forming device in Embodiment 2 will be described. The image forming device in Embodiment 2 has a similar structure to the image forming device in Embodiment 1, but differs therefrom in the structure of the cleaning device. In the following, only the differences will be described.

(1) Structure of Cleaning Device

First, the structure of the cleaning device in the present embodiment will be described.

Figure 7:
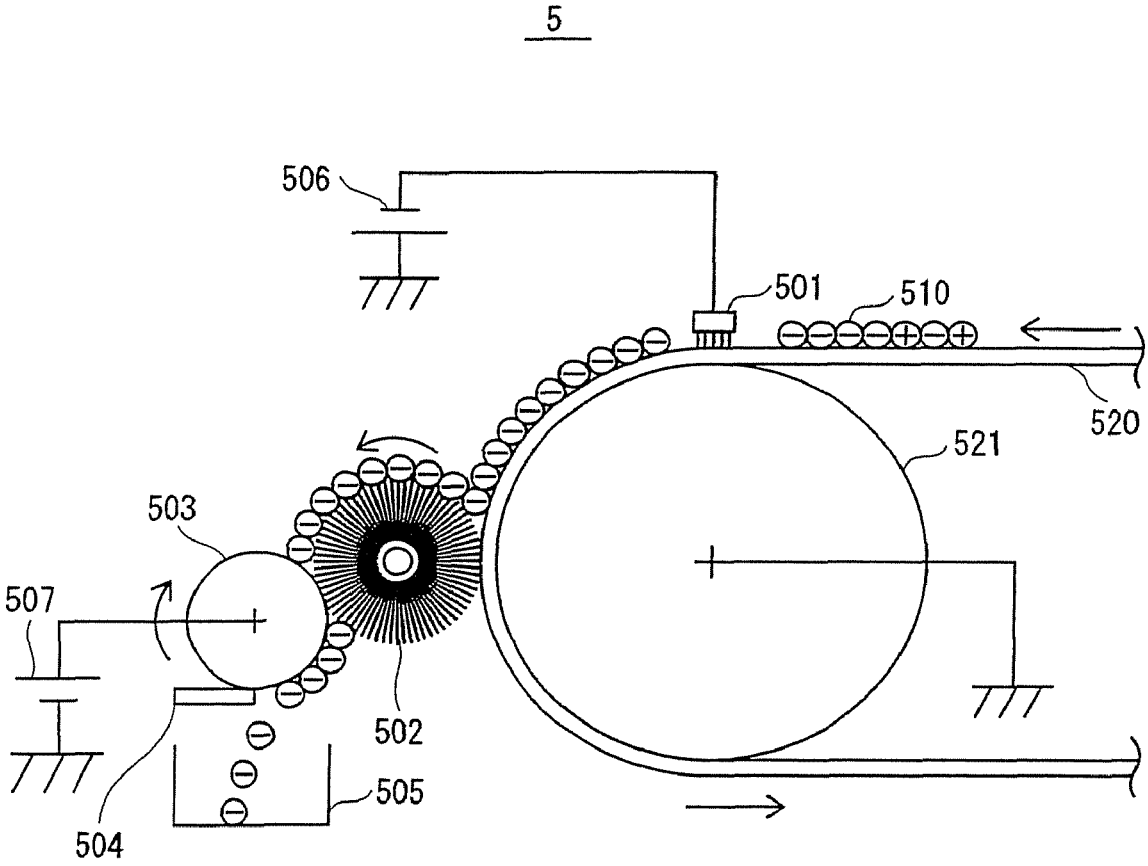
FIG. 7 shows a main structure of the cleaning device in Embodiment 2.

FIG. 7 shows a main structure of the cleaning device in the present embodiment.

As shown in FIG. 7, a cleaning device 5 includes a charging brush 501, a cleaning brush 502, a collection roller 503, a scraper 504, a disposal toner box 505, and constant voltage sources 506 and 507.

The charging brush 501 is a bar brush having electrically conductive bristles planted therein, and is constructed to contact with an intermediate transfer belt 520. A constant voltage source 506 applies to the charging brush 501 a bias that has the same polarity as the toner (in the example of FIG. 5, negative electric charge). A suspension roller 521 is grounded. The current flows from the charging brush 501 to the suspension roller 521 so as to cause residual toner 510 to have the same polarity.

The cleaning brush 502 has the same structure and operates in the same manner as the cleaning brush 202 to electrostatically adsorb the residual toner 510. The collection roller 503 has the same structure and operates in the same manner as the collection roller 203 to collect the residual toner 510 from the cleaning brush 502.

The scraper 504 discards the collected residual toner 510 into the disposal toner box 505. When the cleaning brush 502 has failed to remove all external additive that, a filming removing member (not illustrated) mechanically scrapes off and collects the external additive.

(3) Charging Brush 501

Next, the charging brush 501 will be described.

(a) Manufacturing Method of Charging Brush 501

Figure 8A:
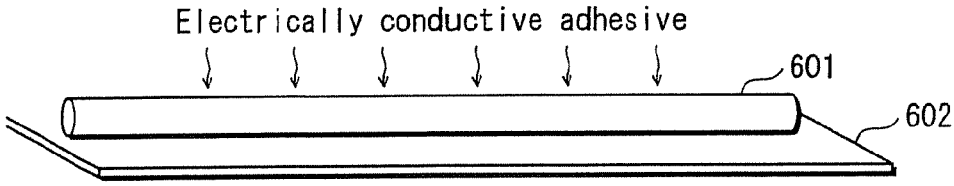
FIGS. 8A and 8B show an example of the manufacturing process of the charging brush 501 by the electrostatic planting method.
Figure 8B:
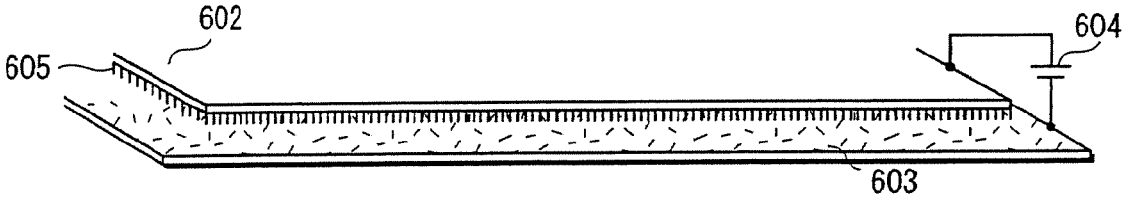

In the process of manufacturing the charging brush 501, bristles are planted by the electrostatic planting method. FIGS. 8A and 8B show an example of the manufacturing process of the charging brush 501 by the electrostatic planting method. The process proceeds in the order from 8A to 8B.

As shown in FIGS. 8A and 8B, first, an application roller 601, while it is rotating, is pressed to a metal plate 602, and in this state, a liquid conductive adhesive is supplied to the circumferential surface of the application roller 601 (FIG. 8A). This enables the conductive adhesive to be evenly applied to one main surface of the metal plate 602, so that an electrically conductive adhesive layer (not illustrated) that is even in thickness is formed on the main surface of the metal plate 602.

Next, the metal plate 602 is disposed above a metal plate 603 on which a large amount of bristles are laid, with a predetermined distance from the surface of the metal plate 603 and to be parallel with the surface. In this state, a constant voltage source 604 applies a constant voltage between the metal plates 602 and 603.

This enables the bristles on the metal plate 603 are electrostatically adsorbed and planted into the whole surface of the conductive adhesive layer to form a planted bristle layer 605 (FIG. 8B) thereon. Then, after the adhesive layer is hardened, a cutter is applied to the planted bristle layer 605 so that the planted bristle layer 605 is cut to an even height.

(b) State of Bristles Planted in Charging Brush 501

Next, the state of the bristles planted in the charging brush 501 will be described.

Figure 9A:
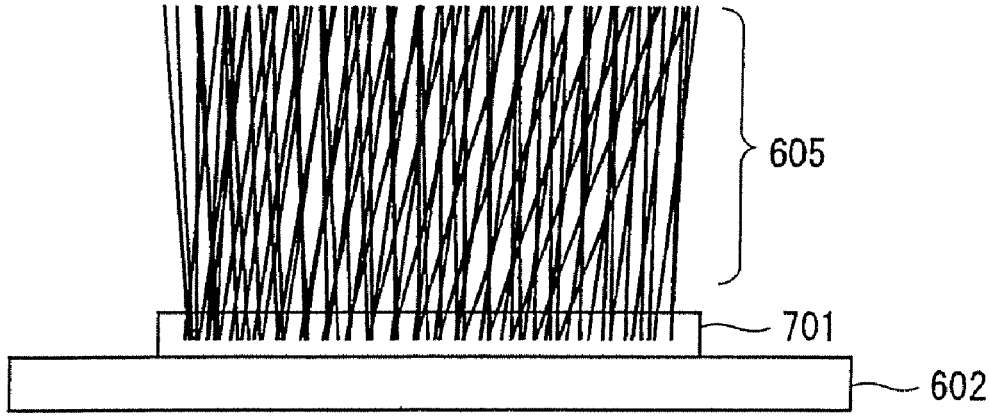
FIGS. 9A and 9B show outer appearances of the charging brush 501, FIG. 9A being a side view, FIG. 9B being a perspective view.
Figure 9B:
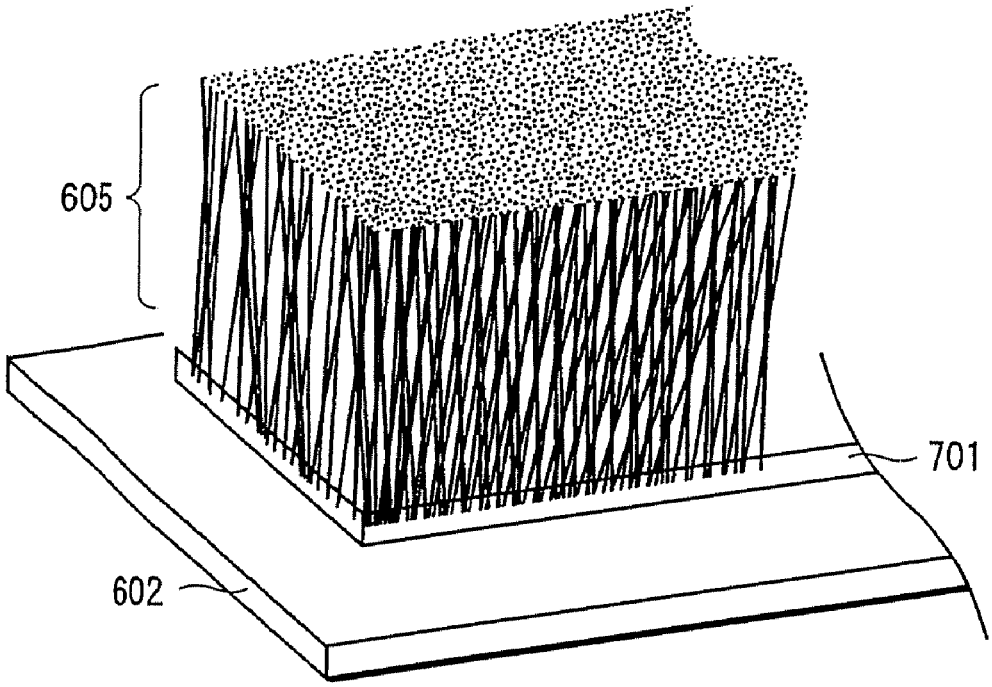

FIGS. 9A and 9B show outer appearances of the charging brush 501. FIG. 9A is a side view; and FIG. 9B is a perspective view. As shown in FIGS. 9A and 9B, the bristles have been planted randomly to be distributed evenly in density, as is the case with the charging brush 201. That is to say, the density of the bristles planted in the surface of the charging brush 501 is 279 F/mm$^2$ or higher in any area on the surface of the charging brush 501. With this structure, the problem of uneven charging of the residual toner is solved.

[3] Modifications

Up to now, the present invention has been described via the embodiments thereof. However, the present invention is not limited to the embodiments, but may be modified in various ways. The following are examples of such modifications.

(1) In the above-described embodiments, the suspension rollers 103 and 521 are grounded. However, not limited to this, the present invention may have the following structures.

Figure 10:
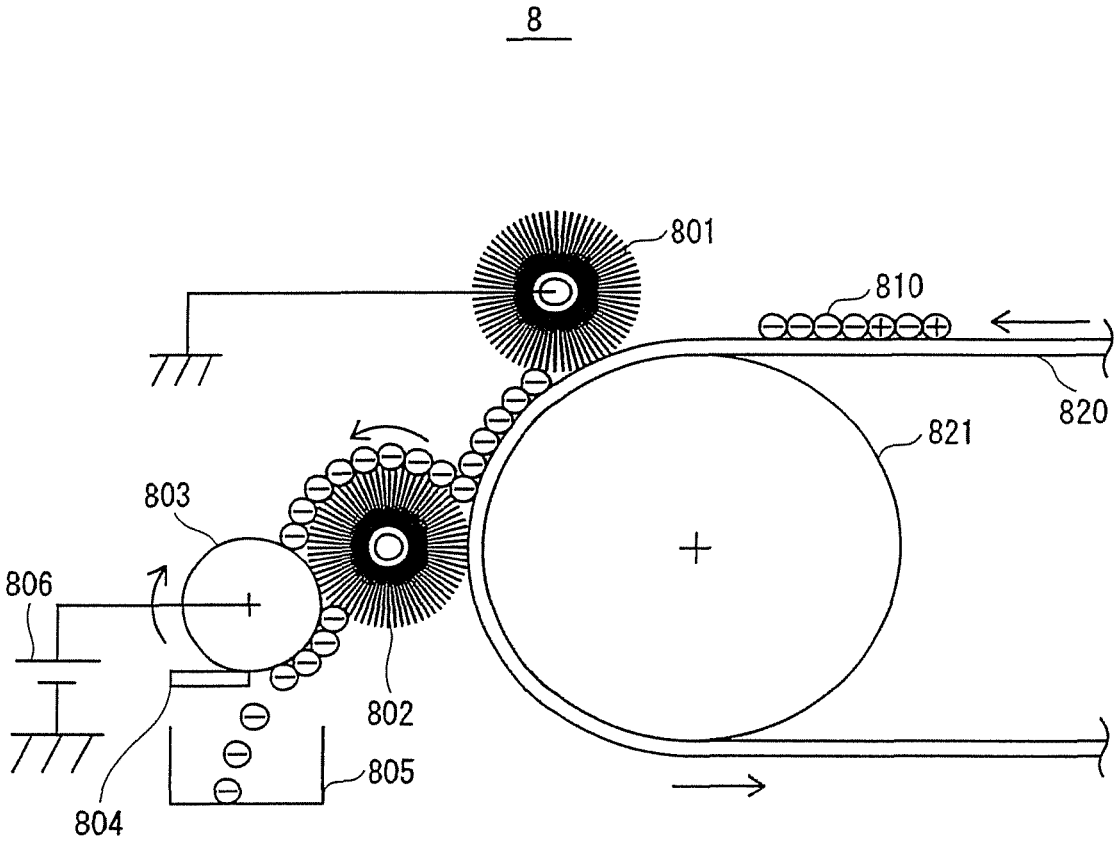
FIG. 10 shows a main structure of the cleaning device in Modification (1)
Figure 11:
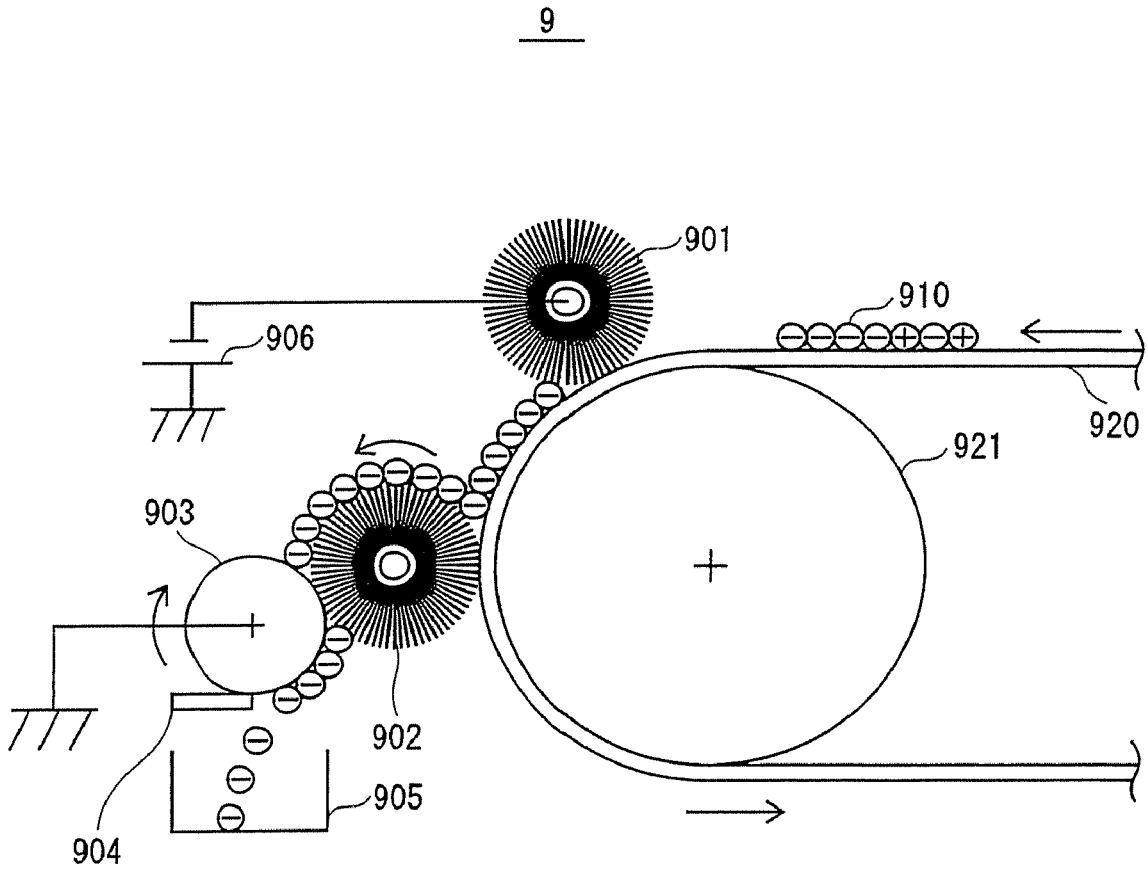
FIG. 11 shows a main structure of the cleaning device in Modification (1)

That is to say, suspension rollers for suspending the intermediate transfer belt may be supported by bearings that are made of insulating resin. Further, to prevent short circuits from occurring via the bearings, any of the following structures may be adopted: (a) when a roll brush is used as the charging brush, a charging brush 801 is grounded as shown in FIG. 10; and a collection roller 903 is grounded as shown in FIG. 11.

Figure 12:
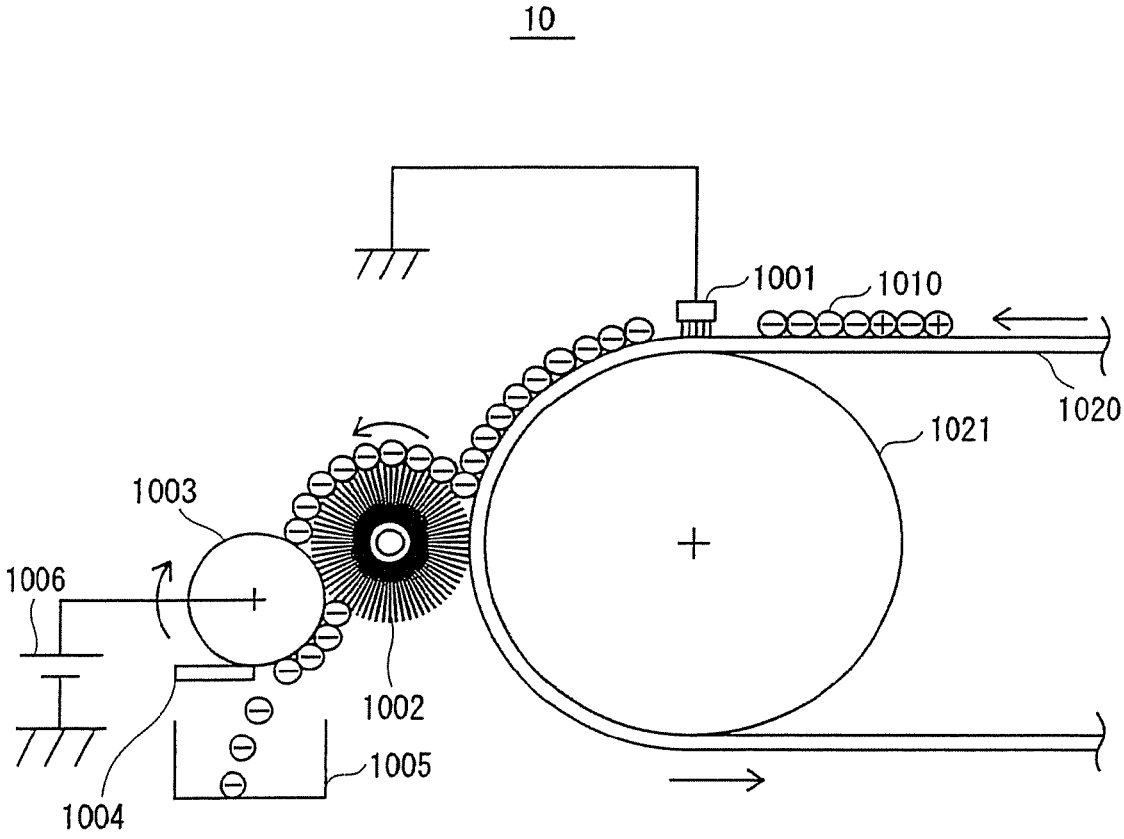
FIG. 12 shows a main structure of the cleaning device in Modification (1)
Figure 13:
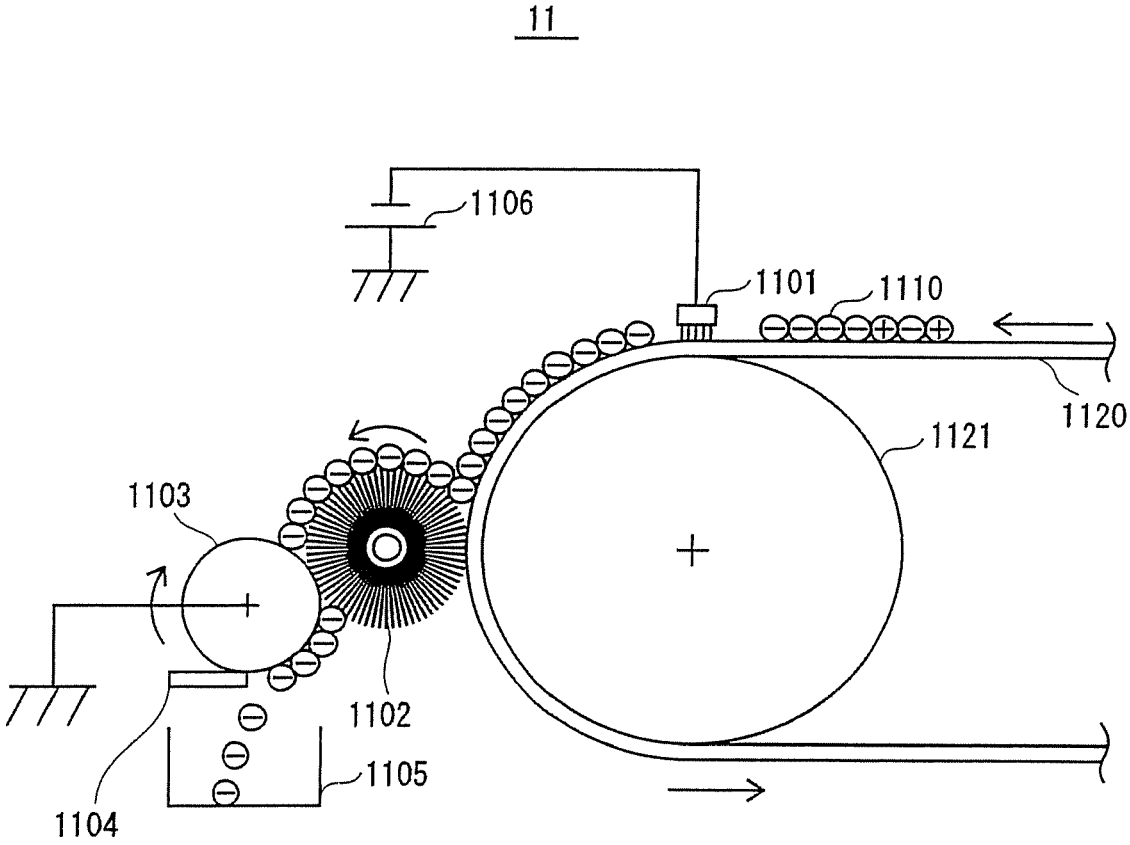
FIG. 13 shows a main structure of the cleaning device in Modification (1)

Also, when a bar brush is used as the charging brush, a charging brush 1001 may be grounded as shown in FIG. 12, or a collection roller 1103 may be grounded as shown in FIG. 13. With any of these structures, only one constant voltage source can be used to obtain the same advantageous effects described in the embodiments above.

(2) In the above-described embodiments, all the charging brushes for use have been manufactured by the electrostatic planting method. However, not limited to these, the present invention can adopt other charging brushes that have been manufactured by planting methods other than the electrostatic planting method. Any brushes may produce the advantageous effects described in the above embodiments in so far as bristles have been planted randomly to be distributed evenly in density.

(3) The above-described embodiments show merely examples in which a tandem color image forming device is used. However, not limited to this, the present invention is applicable to image forming devices of the other types to obtain the advantageous effects.

Figure 14:
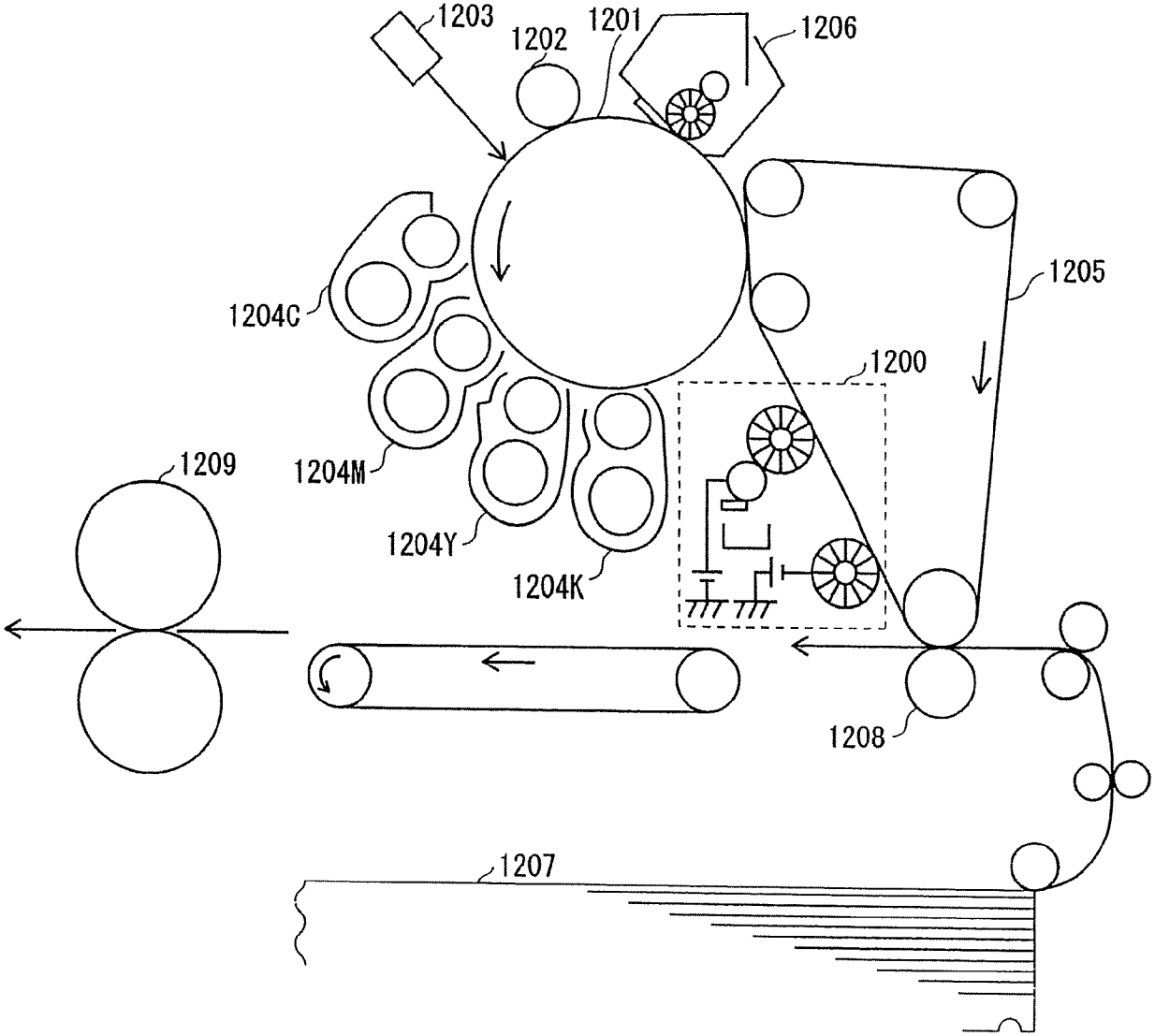
FIG. 14 shows a main structure of the image forming device in Modification (3)

For example, the present invention is applicable to an image forming device of an intermediate transfer type in which a plurality of colors share one photosensitive drum. FIG. 14 shows a main structure of the image forming device in the present modification. As shown in FIG. 14, an image forming device 12 includes a cleaning device 1200, a photosensitive drum 1201, a charging device 1202, an exposure device 1203, developing devices 1204C, 1204M, 1204Y and 1204K, an intermediate transfer belt 1205, a photosensitive drum cleaning device 1206, a paper feed cassette 1207, a second transfer roller 1208, and a fixing device 1209.

With this structure, the image forming device 12 forms an image as follows. First, the charging device 1202 charges the surface of the photosensitive drum 1201 evenly. The exposure device 1203 performs the exposure process to form a static latent image. The developing device 1204C forms a toner image of cyan (C) and transfers the toner image onto the intermediate transfer belt 1205. After the transfer, the toner remaining on the surface of the photosensitive drum 1201 is removed by the photosensitive drum cleaning device 1206.

Stepping up the transfer bias for transferring a toner image onto the intermediate transfer belt 1205, the same process is repeated for magenta (M), yellow (Y) and black (K). Through this process, toner images of the four colors are combined into one toner image on the intermediate transfer belt 1205. The resultant toner image is transferred by the second transfer roller 1208 onto a recording sheet fed by the paper feed cassette 1207.

The cleaning device 1200 is attached such that it can contact with and separate from the intermediate transfer belt 1205, and while a toner image is formed, the cleaning device 1200 is separated from the intermediate transfer belt 1205. On the other hand, after the second transfer, the cleaning device 1200 is contacted with the intermediate transfer belt 1205 to remove the residual toner from the surface of the intermediate transfer belt 1205.

It should be noted here that the cleaning device 1200 shown in FIG. 14 has the same structure as the cleaning device 100 of Embodiment 1, but that the cleaning device 1200 may have the structure of the cleaning device of Embodiment 2 or Modification (1).

The recording sheet is transported to the fixing device 1209, and the fixing device 1209 melts and presses the toner image onto the recording sheet.

With such a structure described above, the same advantageous effects of the present invention can be obtained.

(4) In the above-described embodiments, nylon strings are used as the bristles of the charging brush. However, the present invention is not limited to this. The advantageous effects of the present invention can be obtained by using a synthetic fiber made of any combination of an electrically conductive ester-based resin, an electrically conductive rayon-based resin, an electrically conductive acrylic-based resin, and an electrically conductive polypropylene-based resin, instead of an electrically conductive nylon-based resin.

(5) Although not specifically mentioned in the above-described embodiments, the E-SPART analyzer EST-3 (made by Hosokawa Micron Corporation) can be used to measure each particle diameter and the charge amount distribution of the residual toner on the intermediate transfer belt.

If the measuring results show that 12% or less of the residual toner in amount is oppositely charged, after the residual toner is charged evenly using a charging brush, the filming removing member, which is disposed downstream of the intermediate transfer belt, can remove the residual toner which the cleaning brush has failed to collect, and thus an image quality deterioration is prevented from being generated.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A cleaning device for cleaning residual toner that, in an image forming device of an intermediate transfer type, remains on an outer circumferential surface of an intermediate transfer member after a transfer, the cleaning device comprising:

a charging brush operable to contact with and charge the residual toner; and a cleaner that is disposed downstream of the charging brush in a toner transport direction of the intermediate transfer member, and is operable to electrostatically adsorb the charged residual toner, wherein electrically conductive bristles have been planted randomly in the charging brush to be distributed evenly in density.

2. The cleaning device of claim 1, wherein the bristles have been planted in the charging brush by an electrostatic planting method.

3. The cleaning device of claim 1, wherein the charging brush is either a roll brush or a bar brush.

4. A cleaning device for cleaning residual toner that, in an image forming device of an intermediate transfer type, remains on an outer circumferential surface of an intermediate transfer member after a transfer, the cleaning device comprising:

a charging brush operable to contact with and charge the residual toner; and a cleaner that is disposed downstream of the charging brush in a toner transport direction of the intermediate transfer member, and is operable to electrostatically adsorb the charged residual toner, wherein 279 or more electrically conductive bristles have been planted in any one square millimeter area in a bristle planting region of the charging brush.

5. The cleaning device of claim 4, wherein each of the electrically conductive bristles is 2 denier in thickness.

6. The cleaning device of claim 4, wherein the bristles of the charging brush are a combination of one or more types of bristles each of which is made of a material selected from the group consisting of an electrically conductive nylon-based resin, an electrically conductive ester-based resin, an electrically conductive rayon-based resin, an electrically conductive acrylic-based resin, and an electrically conductive polypropylene-based resin.

7. The cleaning device of claim 4, wherein the electrically conductive bristles extend along the charging brush from one axial end of the planted region to the other axial end of the planted region without uniform gaps or spacing between any two adjacent square millimeters of the conductive bristles.

8. An image forming device of an intermediate transfer type including a cleaning device for cleaning residual toner that remains on an outer circumferential surface of an intermediate transfer member after a transfer, the cleaning device comprising:

a charging brush operable to contact with and charge the residual toner; and a cleaner that is disposed downstream of the charging brush in a toner transport direction of the intermediate transfer member, and is operable to electrostatically adsorb the charged residual toner, wherein electrically conductive bristles have been planted randomly in the charging brush to be distributed evenly in density.

9. An image forming device of an intermediate transfer type including a cleaning device for cleaning residual toner that remains on an outer circumferential surface of an intermediate transfer member after a transfer, the cleaning device comprising:

a charging brush operable to contact with and charge the residual toner; and a cleaner that is disposed downstream of the charging brush in a toner transport direction of the intermediate transfer member, and is operable to electrostatically adsorb the charged residual toner, wherein 279 or more electrically conductive bristles have been planted in any one square millimeter area in a bristle planting region of the charging brush.

10. The cleaning device of claim 9, wherein the electrically conductive bristles extend along the charging brush from one axial end of the planted bristles to the other axial end of the planted bristles without uniform gaps or spacing between any two adjacent square millimeters of the conductive bristles.

* * * * *